US010150655B2

(12) United States Patent
Hiekata et al.

(10) Patent No.: US 10,150,655 B2
(45) Date of Patent: Dec. 11, 2018

(54) ELECTRIC WINCH DEVICE

(71) Applicants: Kobe Steel, Ltd., Kobe-shi (JP); KOBELCO CONSTRUCTION MACHINERY CO., LTD., Hiroshima-shi (JP)

(72) Inventors: Takashi Hiekata, Kobe (JP); Hiroaki Kawai, Kobe (JP); Toshiro Yamashita, Hyogo (JP); Shintaro Sasai, Hyogo (JP); Naoto Hori, Hyogo (JP); Koichi Shimomura, Hyogo (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 229 days.

(21) Appl. No.: 15/304,736

(22) PCT Filed: Apr. 7, 2015

(86) PCT No.: PCT/JP2015/060807
§ 371 (c)(1),
(2) Date: Oct. 17, 2016

(87) PCT Pub. No.: WO2015/163137
PCT Pub. Date: Oct. 29, 2015

(65) Prior Publication Data

US 2017/0043983 A1 Feb. 16, 2017

(30) Foreign Application Priority Data

Apr. 21, 2014 (JP) ..... 2014-087315

(51) Int. Cl.
*B66D 1/46* (2006.01)
*B66C 13/28* (2006.01)
(Continued)

(52) U.S. Cl.
CPC ..... *B66C 13/28* (2013.01); *B66C 13/12* (2013.01); *B66D 1/12* (2013.01); *B66D 1/24* (2013.01);
(Continued)

(58) Field of Classification Search
CPC ..... B66C 13/12; B66C 13/28; B66D 1/12; B66D 1/24; B66D 1/46; B66D 1/485; B66D 5/02
See application file for complete search history.

(56) References Cited

U.S. PATENT DOCUMENTS 3,376,020 A * 4/1968 Klinke ..... B66D 1/26 254/297
3,388,890 A * 6/1968 Born ..... B66D 1/08 226/195
(Continued)

FOREIGN PATENT DOCUMENTS

JP 2007-131454 A 5/2007
JP 2007-276989 A 10/2007
(Continued)

OTHER PUBLICATIONS

International Search Report dated Jun. 30, 2015 in PCT/JP2015/060807 filed Apr. 7, 2015.

*Primary Examiner* — Emmanuel M Marcelo
(74) *Attorney, Agent, or Firm* — Oblon, McClelland, Maier & Neustadt, L.L.P.

(57) ABSTRACT

An electric winch device including an electric motor that rotates a winch drum in a hoisting direction, and generates regenerative electric power when a rotation of the winch drum in a lowering direction is transmitted to the electric motor, a transmission device that transmits the rotation between the electric motor and the winch drum, a power calculating section that calculates power of the target object by freefall, and a control section that controls an operation
(Continued)

of the transmission device. When the power calculated by the power calculating section exceeds reference electric power, the control section causes the transmission device to change the transmission rate of the rotation to a transmission rate at which the regenerative electric power generated by the electric motor is equal to or smaller than the reference electric power.

8 Claims, 8 Drawing Sheets

(51) Int. Cl.

| | |
|---|---|
| ***B66C 13/12*** | (2006.01) |
| ***B66D 1/12*** | (2006.01) |
| ***B66D 1/24*** | (2006.01) |
| ***B66D 1/48*** | (2006.01) |
| ***B66D 5/02*** | (2006.01) |

(52) U.S. Cl.
CPC ..... *B66D 1/46* (2013.01); *B66D 1/485* (2013.01); *B66D 5/02* (2013.01)

(56) References Cited

U.S. PATENT DOCUMENTS

| | | | | |
|---|---|---|---|---|
| 2010/0057279 | A1* | 3/2010 | Kyllingstad | E21B 19/09 701/21 |
| 2011/0303886 | A1* | 12/2011 | Cryer | B66D 1/22 254/340 |
| 2012/0089287 | A1* | 4/2012 | Nishiyama | B66C 13/12 701/22 |
| 2013/0221809 | A1* | 8/2013 | Hiroshima | B66D 3/20 310/60 R |
| 2014/0171260 | A1* | 6/2014 | Dalum | B60W 20/10 477/5 |
| 2017/0066634 | A1* | 3/2017 | Kawai | B66D 5/02 |
| 2017/0210606 | A1* | 7/2017 | Kawai | B60T 8/17 |

FOREIGN PATENT DOCUMENTS

| | | | |
|---|---|---|---|
| JP | 2012-121675 | A | 6/2012 |
| JP | 2013-107721 | A | 6/2013 |
| WO | 2011/129705 | A1 | 10/2011 |

* cited by examiner

ELECTRIC WINCH DEVICE

TECHNICAL FIELD

The present invention relates to an electric winch device used in a crane.

BACKGROUND ART

As a winch device mounted on a crane to perform hoisting work (crane work), there has been known an electric winch device driven by an electric motor to hoist a target object of the hoisting work. As the electric winch device, there has been known an electric winch device including a regeneration function for converting kinetic energy generated by a fall of a target object during the lowering of the target object into electric energy and collecting the electric energy.

Patent Literature 1 described below discloses an example of the electric winch device including such a regeneration function. The electric winch device disclosed in Patent Literature 1 includes a winding drum that winds a wire for suspending a hook block and an electric motor that rotates the winding drum in a hoisting direction of the hook block. During the lowering of the hook block, the electric motor generates regenerative electric power and the generated regenerative electric power is consumed by a power consuming system connected to the electric motor.

Incidentally, in a mobile crane, an electric winch device capable of implementing a freefall of a target object to be dropped in a nearly free fall state of the target object is sometimes used. When such an electric winch device includes the regeneration function, regenerative electric power is generated by the electric motor during the freefall of the target object.

Falling speed of the target object during the freefall is large compared with speed of the target object during the hoisting of the target object. Therefore, the regenerative electric power regenerated by the electric motor during the freefall of the target object is larger than power-running electric power supplied to the electric motor during the hoisting of the target object. As a height position of the target object is higher, a difference between regenerative electric power regenerated by the electric motor during a freefall of the target object from the height position and power-running electric power required by the electric motor to hoist the target object to the height position is larger.

Since the regenerative electric power during the freefall of the target object is larger than the power-running electric power during the hoisting of the target object as explained above, allowable electric power such as rated electric power or maximum electric power of the electric motor has to be set on the basis of a maximum of the regenerative electric power during the freefall. Moreover, when the difference between the regenerative electric power during the freefall of the target object and the power-running electric power during the hoisting of the target object expands as explained above, that is, when the maximum of the regenerative electric power during the freefall of the target object increases, an extremely large value is requested as the allowable electric power of the electric motor to make it possible to cope with the increase in the maximum of the regenerative electric power.

Therefore, the electric motor used in the conventional electric winch device not including the freefall function cannot cope with the increase in the maximum of the regenerative electric power. An electric motor having large allowable electric power capable of coping with the regenerative electric power during the freefall is necessary. Such an electric motor having large allowable electric power is large and expensive. In order to control the electric motor having the large allowable electric power, large and expensive components for control such as an inverter are also necessary. Therefore, the electric winch device increases in size and the manufacturing cost of the electric winch device increases.

CITATION LIST

Patent Literature

Patent Literature 1: Japanese Unexamined Patent Publication No. 2012-121675

SUMMARY OF INVENTION

An object of the present invention is to prevent an increase in the size and an increase in the manufacturing cost concerning an electric winch device of a crane including a regeneration function and capable of implementing a freefall of a target object.

An electric winch device according to an aspect of the present invention is an electric winch device provided in a crane to perform hoisting and lowering of a target object, the electric winch device comprising: a winch drum which rotates for the hoisting and the lowering of the target object; an electric motor which rotates the winch drum in a hoisting direction during the hoisting of the target object, and generates regenerative electric power when a rotation of the winch drum in a lowering direction during a freefall of the target object is transmitted to the electric motor; a transmission device which transmits the rotation between the electric motor and the winch drum, the transmission device having a variable transmission rate which is a rate of transmission of the rotation of the winch drum in the lowering direction during the freefall to the electric motor; a power calculating section which calculates power of the target object by the freefall; and a control section which controls an operation of the transmission device for changing the transmission rate. When the power calculated by the power calculating section exceeds reference electric power set according to allowable electric power of the electric motor, the control section causes the transmission device to change the transmission rate of the rotation from the winch drum to the electric motor to a transmission rate at which the regenerative electric power generated by the electric motor is equal to or smaller than the reference electric power.

DESCRIPTION OF EMBODIMENTS

Figure 1:
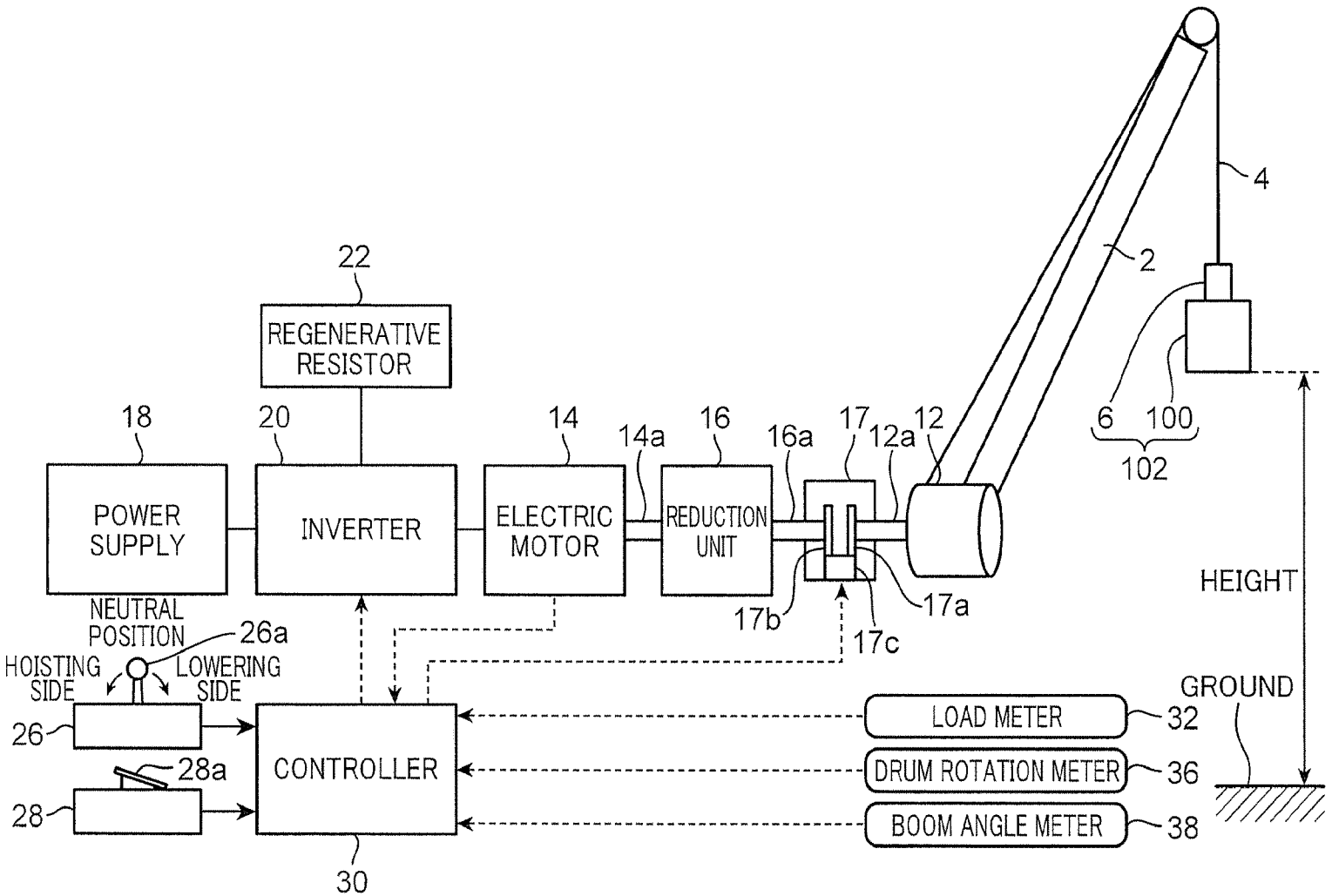
FIG. 1 is a schematic diagram of the configuration of an electric winch device according to a first embodiment of the present invention.

Embodiments of the present invention are explained below with reference to the drawings.

(First Embodiment)

First, the configuration of an electric winch device according to a first embodiment of the present invention is explained with reference to FIG. 1 and FIG. 2.

The electric winch device according to the first embodiment is provided in a crane. The electric winch device is used as a winch device for load hoisting that performs hoisting/lowering (winding-up/winding-down) of a lifting load 100 (see FIG. 1). The crane provided with the electric winch device includes a boom 2 (see FIG. 1) provided in a not-shown crane main body to be capable of raising and lowering. A hook device 6 is suspended from the distal end of the boom 2 via a hoisting rope 4, which is a wire rope. The lifting load 100 is hoisted by the hook device 6. In the following explanation, the hook device 6 and the lifting load 100 hoisted by the hook device 6 are collectively referred to as target object 102 of hoisting/lowering. The electric winch device is mounted on the not-shown crane main body and performs hoisting/lowering of the target object 102 via the hoisting rope 4.

A specific configuration of the electric winch device according to the first embodiment is explained below.

The electric winch device according to the first embodiment is configured to be capable of implementing a freefall of the target object 102. The electric winch device according to the first embodiment includes a regeneration function for converting kinetic energy of the target object 102 generated by a fall of the target object 102 into electric power and collecting the electric power. Note that the freefall of the target object 102 means that the target object 102 is dropped in a nearly free fall state. The electric winch device includes, as shown in FIG. 1, a drum 12, an electric motor 14, a reduction unit 16, a clutch 17, a power supply 18, an inverter 20, a regenerative resistor 22, an operation lever device 26, a brake pedal device 28, a controller 30, a load meter 32, a drum rotation meter 36, and a boom angle meter 38.

The drum 12 (see FIG. 1) is a winch drum driven by the electric motor 14 to rotate for hoisting/lowering of the hook device 6. That is, the drum 12 is driven by the electric motor 14 to perform the hoisting/lowering of the target object 102. The drum 12 winds the hoisting rope 4 by rotating in a hoisting direction, which is one rotating direction, to thereby hoist (wind up) the target object 102. The drum 12 lets out the hoisting rope 4 by rotating in a lowering direction, which is a rotating direction opposite to the hoisting direction, to thereby lower (wind down) the target object 102. During the freefall of the target object 102, the drum 12 rotates in the lowering direction to drop the target object 102. A first rotating shaft 12*a* is fixed to the drum 12 to be coaxial with the drum 12. The first rotating shaft 12*a* rotates integrally with the drum 12. An end portion of the first rotating shaft 12*a* on the opposite side of the drum 12 is connected to the clutch 17.

The electric motor 14 (see FIG. 1) operates when electric power is supplied to the electric motor 14 and rotates the drum 12 in the hoisting direction during the hoisting of the target object 102. The electric motor 14 rotates the drum 12 in the lowering direction during the lowering of the target object 102. During the freefall of the target object 102, the electric motor 14 operates to rotate oppositely from the rotation during the hoisting of the target object 102 when a rotation of the drum 12 in the lowering direction is transmitted to the electric motor 14. During the lowering and during the freefall of the target object 102, the electric motor 14 functions as a generator and generates regenerative electric power. A driving shaft 14*a* of the electric motor 14 is connected to the reduction unit 16.

The reduction unit 16 (see FIG. 1) includes a second rotating shaft 16*a* connected to the clutch 17. The reduction unit 16 decelerates a rotation of the driving shaft 14*a* of the electric motor 14 at a predetermined reduction ratio and transmits the rotation to the clutch 17 and drum 12 side via the second rotating shaft 16*a*.

The clutch 17 (see FIG. 1) transmits a rotation between the electric motor 14 and the drum 12, specifically, between the reduction unit 16 and the drum 12. The clutch 17 is configured to be capable of changing a transmission rate of a rotation to the electric motor 14 side in the lowering direction of the drum 12 during the freefall of the target object 102. The clutch 17 is an example of a transmission device of the present invention.

The clutch 17 includes a first clutch plate 17*a*, a second clutch plate 17*b*, and a clutch driving section 17*c*. The first clutch plate 17*a* is fixed to the end portion of the first rotating shaft 12*a* on the opposite side of the drum 12. The first clutch plate 17*a* rotates integrally with the first rotating shaft 12*a* and the drum 12. The second clutch plate 17*b* is fixed to an end portion of the second rotating shaft 16*a* on the opposite side of the reduction unit 16. The second clutch plate 17*b* rotates integrally with the second rotating shaft 16*a*. The second clutch plate 17*b* rotates integrally with the second rotating shaft 16*a* to thereby rotate together with the driving shaft 14*a* of the electric motor 14 via the reduction unit 16. The first clutch plate 17*a* is an example of a first rotating section of the present invention. The second clutch plate 17*b* is an example of a second rotating section of the present invention.

The clutch driving section 17*c* (see FIG. 1) is a section for changing a coupling state between the first clutch plate 17*a* and the second clutch plate 17*b*. The clutch driving section 17*c* is an example of a changing device of the present invention. The clutch driving section 17*c* changes the coupling state between the first clutch plate 17*a* and the second clutch plate 17*b* to thereby change the transmission rate of the rotation of the drum 12 to the electric motor 14 side by the clutch 17.

Specifically, the clutch driving section 17*c* is configured to be capable of driving the first clutch plate 17*a* and the second clutch plate 17*b* in directions in which the first clutch plate 17*a* and the second clutch plate 17*b* approach and separate from each other in the axial direction of the rotating shafts 12*a* and 16*a*. The clutch driving section 17*c* is electrically connected to the controller 30. The clutch driving section 17*c* drives, according to a control signal from a control section 46 of the controller 30, the first clutch plate 17*a* and the second clutch plate 17*b* in the direction in which the first clutch plate 17*a* and the second clutch plate 17*b* approach and separate from each other. Consequently, the coupling state of the clutch plates 17*a* and 17*b* is changed.

During normal hoisting and lowering of the target object 102, the clutch 17 is switched to a directly connected state in which the first clutch plate 17*a* and the second clutch plate 17*b* integrally rotate at the same rotating speed. On the other hand, during the freefall of the target object 102, the clutch 17 adjusts the coupling state of the first clutch plate 17*a* and the second clutch plate 17*b* according to a control signal from the control section 46 of the controller 30.

The power supply 18 (see FIG. 1) is electrically connected to the electric motor 14 via the inverter 20. The power supply 18 supplies electric power to the electric motor 14 via the inverter 20. As the power supply 18, a battery mounted on the crane, an external power supply, or the like is used.

The inverter 20 (see FIG. 1) controls the operation of the electric motor 14 according to a command from the controller 30. Specifically, the inverter 20 controls rotating speed and a rotation amount of the electric motor 14 by changing, according to the command from the controller 30, the magnitude of an electric current supplied to the electric motor 14 to thereby control a hoisting speed and a hoisting amount of the target object 102.

The regenerative resistor 22 (see FIG. 1) is electrically connected to the inverter 20. The regenerative resistor 22 consumes electric power that cannot be fully absorbed by the power supply 18 in regenerative electric power generated by the electric motor 14 during the normal lowering and freefall of the target object 102.

The operation lever device 26 (see FIG. 1) is a device used by an operator to instruct hoisting/lowering operations of the target object 102 by the electric winch device. The operation lever device 26 includes a lever 26*a* operated by the operator to instruct rotation of the drum 12 in the hoisting direction and rotation in the lowering direction or a stop of the rotation. The lever 26*a* can be operated to a hoisting side, which is one side for instructing rotation of the drum 12 in the hoisting direction of the target object 102 from a neutral position for instructing a stop of the rotation of the drum 12, and a lowering side, which is the other side (the opposite side of the hoisting side) for instructing rotation of the drum 12 in the lowering direction of the target object 102 from the neutral position. The operation lever device 26 outputs information, which indicates an operation direction and an operation amount from the neutral position of the lever 26*a*, to the controller 30.

The brake pedal device 28 (see FIG. 1) is a device that outputs, to the controller 30, a command for stopping a fall of the target object 102 during the freefall of the target object 102. The brake pedal device 28 includes a brake pedal 28*a* operated by the operator in order to stop the freefall of the target object 102. The brake pedal 28*a* is an example of a brake operation section of the present invention. In the following explanation, the brake pedal 28*a* is simply referred to as pedal 28*a*.

The brake pedal device 28 outputs a signal indicating an operation state of the pedal 28*a* to the controller 30. Specifically, the pedal 28*a* is disposed in a reference position lifted most in a state in which the pedal 28*a* is not operated by the operator, that is, a state in which the pedal 28*a* is not stepped in. In this state, the brake pedal device 28 outputs a signal indicating that an operation amount of the pedal 28*a* is zero to the controller 30. When the pedal 28*a* is operated (stepped in) from the reference position by the operator, the brake pedal device 28 outputs a signal, which indicates an operation amount (a step-in amount) of the pedal 28*a* from the reference position, to the controller 30. The state in which the pedal 28*a* is disposed in the reference position is a state for instructing implementation of the freefall of the target object 102. The state in which the pedal 28*a* is stepped in is a state for instructing a stop of the freefall of the target object 102.

In the electric winch device, a normal operation mode in which the hoisting/lowering of the target object 102 is performed according to the operation of the lever 26*a* and a freefall mode for implementing the freefall of the target object 102 can be selected. The brake pedal device 28 is used when the freefall mode is selected. When the normal operation mode is selected, even if the pedal 28*a* is operated, the operation is ineffective.

The controller 30 (see FIG. 1) controls the operation of the electric motor 14 such that the drum 12 performs rotation corresponding to the operation of the lever 26*a*. The controller 30 performs operation control of the clutch 17 corresponding to the operation of the pedal 28*a*. Specifically, according to an input of information indicating an operation direction and an operation amount of the lever 26*a* from the operation lever device 26, the controller 30 controls the inverter 20 to thereby cause the inverter 20 to supply, to the electric motor 14, an electric current for the electric motor 14 to cause the drum 12 to perform rotation corresponding to the information input to the controller 30 from the operation lever device 26. The controller 30 controls the coupling state between the first clutch plate 17*a* and the second clutch plate 17*b* in the clutch 17 according to a signal input from the brake pedal device 28. A detailed internal configuration of the controller 30 is explained below.

The load meter 32 (see FIG. 1) detects a load applied to the drum 12 via the hoisting rope 4. Specifically, the load meter 32 detects the tension of the hoisting rope 4. The load meter 32 successively detects the tension of the hoisting rope 4 and successively outputs data of the detected tension to the controller 30.

The drum rotation meter 36 (see FIG. 1) is a meter that detects the number of rotations per unit time of the drum 12. The drum rotation meter 36 successively detects the number of rotations of the drum 12 and successively outputs data of the detected number of rotations to the controller 30.

Figure 2:
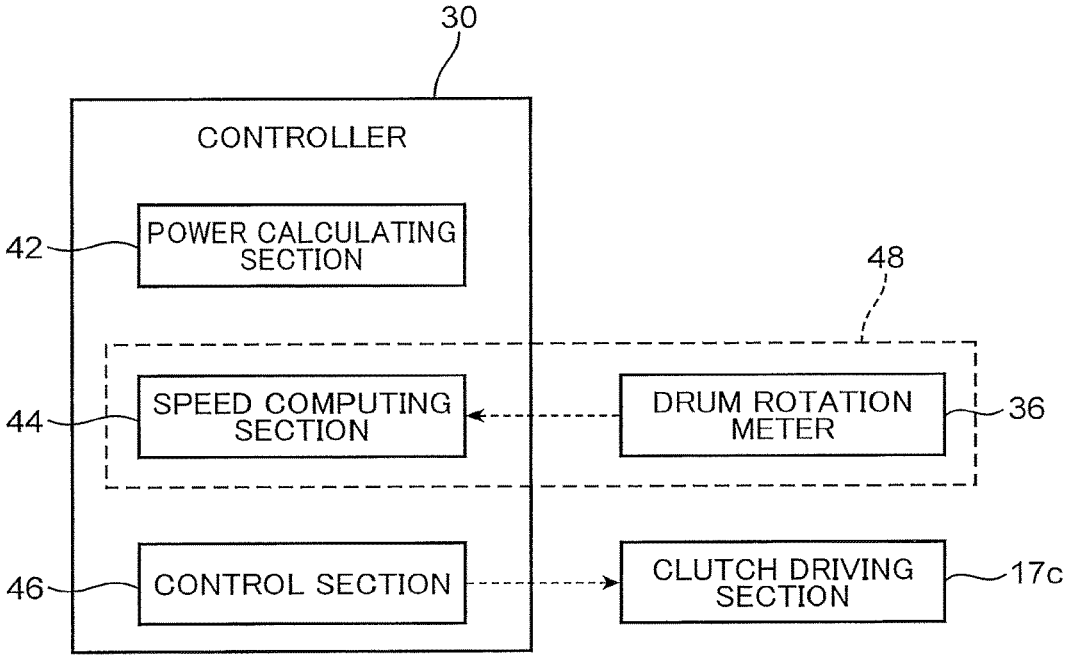
FIG. 2 is a functional block diagram of a controller of the electric winch device according to the first embodiment.

In FIG. 2, the internal configuration of the controller 30 is shown. The internal configuration of the controller 30 is explained with reference to FIG. 2.

The controller 30 includes a power calculating section 42, a speed computing section 44, and the control section 46 as functional blocks.

The power calculating section 42 calculates power of the target object 102 (see FIG. 1) by the freefall of the target object 102. In the first embodiment, the power calculating section 42 calculates, on the basis of falling speed calculated by the speed computing section 44 at timing when brake-on operation of the pedal 28*a* (see FIG. 1) is performed to stop the freefall of the target object 102, power of the target object 102 at the timing as the power of the target object 102 by the freefall.

The speed computing section 44 (see FIG. 2) successively calculates falling speed of the target object 102 on the basis of the number of rotations (rotating speed) per unit time of the drum 12 (see FIG. 1) detected by the drum rotation meter 36. A speed deriving section 48 (see FIG. 2) that successively derives falling speed of the target object 102 is configured by the speed computing section 44 and the drum rotation meter 36.

The control section 46 (see FIG. 2) performs, according to a signal input to the controller 30 from the brake pedal device 28 when brake-off operation of the pedal 28*a* (see FIG. 1) for starting the freefall of the target object 102 is performed, control for causing the clutch driving section 17*c* to separate the first clutch plate 17*a* and the second clutch plate 17*b*.

The control section 46 (see FIG. 2) controls an operation of the clutch 17 (see FIG. 1) for a change of a transmission rate of a rotation during the stop of the freefall of the target object 102. Specifically, when the power calculated by the power calculating section 42 at the timing when the brake-on operation of the pedal 28*a* is performed exceeds reference electric power set according to allowable electric power of the electric motor 14, the control section 46 (see FIG. 2) causes the clutch 17 to reduce the transmission rate of the rotation of the drum 12 to the electric motor 14 side to a transmission rate at which the regenerative electric power generated by the electric motor 14 is equal to or smaller than the reference electric power. More specifically, when the power calculated by the power calculating section 42 exceeds the reference electric power, the control section 46 causes the clutch driving section 17*c* to adjust the coupling state of the first clutch plate 17*a* and the second clutch plate 17*b* to a coupling state in which the first clutch plate 17*a* slips while sliding with respect to the second clutch plate 17*b* and rotating speed of the second clutch plate 17*b* is lower than rotating speed of the first clutch plate 17*a*. As a result, the transmission rate of the rotation to the electric motor 14 side in the lowering direction of the drum 12 by the clutch 17 decreases.

Note that the allowable electric power of the electric motor 14 is rated electric power or maximum electric power of the electric motor 14. The reference electric power of the electric motor 14 is a setting value set in advance. The reference electric power is set to an electric power value equal to the allowable electric power of the electric motor 14 or set to an electric power value calculated by multiplying the allowable electric power of the electric motor 14 with a safety factor smaller than 1.

When the power of the target object 102 calculated by the power calculating section 42 at the timing when the brake-on operation of the pedal 28*a* is performed is equal to or smaller than the reference electric power, the control section 46 causes the clutch 17 to transmit the rotation of the drum 12 to the electric motor 14 side at a transmission rate of 100%. Specifically, when the power of the target object 102 calculated by the power calculating section 42 is equal to or smaller than the reference electric power, the control section 46 causes the clutch driving section 17*c* to closely attach the first clutch plate 17*a* and the second clutch plate 17*b* such that the first clutch plate 17*a* and the second clutch plate 17*b* integrally rotate at the same speed. That is, the clutch 17 is switched to the directly connected state.

Figure 3:
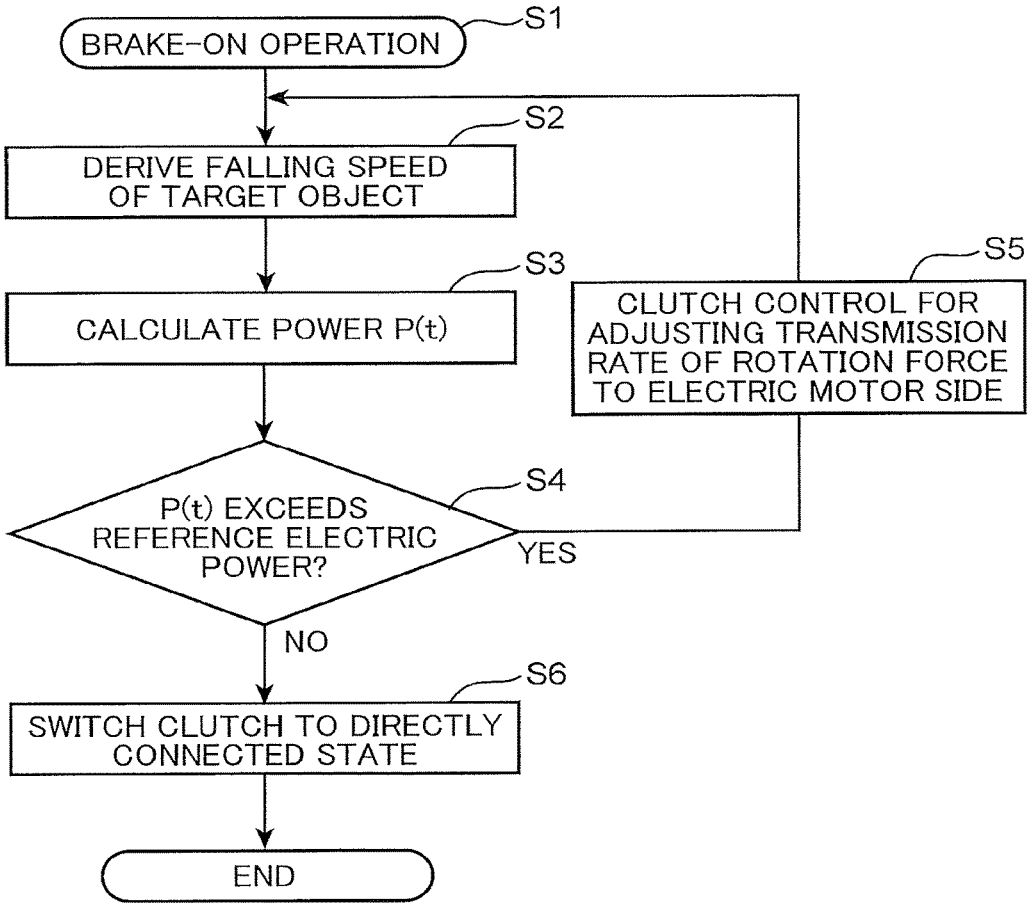
FIG. 3 is a flowchart showing an operation during a stop of a freefall of a target object in the electric winch device according to the first embodiment.

The operation of the electric winch device according to the first embodiment is explained with reference to a flowchart of FIG. 3. Specifically, the operation of the electric winch device in stopping the freefall of the target object 102 is explained.

First, in an initial state, the pedal 28*a* of the brake pedal device 28 is disposed in the reference position, whereby the first clutch plate 17*a* and the second clutch plate 17*b* of the clutch 17 separate from each other. In that state, the target object 102 free-falls and the drum 12 freely rotates in the lowering direction. In this state, brake-on operation for stopping the freefall of the target object 102 is performed by the operator (step S1). That is, the operator steps in the pedal 28*a* from the reference position.

According to the brake-on operation performed by the operator, the speed deriving section 48 derives falling speed of the target object 102 (step S2). Specifically, the speed computing section 44 calculates the falling speed of the target object 102 on the basis of data of the number of rotations per unit time of the drum 12 detected by the drum rotation meter 36, that is, data of letting-out speed of the hoisting rope 4 from the drum 12.

Thereafter, the power calculating section 42 calculates, on the basis of the following Expression (1), power P(t) by the freefall of the target object 102 (step S3).

[Math. 1]

$$P(t)=mgv(t) \tag{1}$$

In Expression (1), m represents the mass of the target object 102, g represents the gravitational acceleration, and v(t) is falling speed of the target object 102 at time t elapsed from a time point of start of the freefall of the target object 102. As the falling speed v(t), the falling speed derived in step S2 is used.

Subsequently, the control section 46 determines whether the power P(t) calculated by the power calculating section 42 exceeds the reference electric power set in advance according to the allowable electric power of the electric motor 14 (step S4).

When determining that the power P(t) exceeds the reference electric power, subsequently, the control section 46 performs control of the clutch 17 for adjusting the transmission rate of the rotation of the drum 12 to the electric motor 14 side (step S5). Specifically, the control section 46 causes the clutch driving section 17*c* to bring the first clutch plate 17*a* and the second clutch plate 17*b* into slight contact with each other such that the rotation of the drum 12 is transmitted to the electric motor 14 side at a certain small transmission rate. Consequently, while the first clutch plate 17*a* rotating integrally with the drum 12 slips while sliding with respect to the second clutch plate 17*b*, a rotation of the first clutch plate 17*a* is transmitted to the second clutch plate 17*b* at the certain small transmission rate.

The rotation transmitted to the second clutch plate 17*b* is transmitted to the electric motor 14 via the second rotating shaft 16*a*, the reduction unit 16, and the driving shaft 14*a* and causes the electric motor 14 to operate as a generator. Consequently, the electric motor 14 generates regenerative electric power extremely small compared with the power P(t) and smaller than the reference electric power. The generated regenerative electric power is absorbed by the power supply 18 and consumed by the regenerative resistor 22. As a result, a regenerative braking force is generated in the electric motor 14. The regenerative braking force acts on the drum 12 from the driving shaft 14*a* via the reduction unit 16, the second rotating shaft 16*a*, the second clutch plate 17*b*, the first clutch plate 17*a*, and the first rotating shaft 12*a*. Therefore, braking is slightly applied to the rotation of the drum 12 in the lowering direction. The rotating speed of the drum 12 slightly decreases and the falling speed of the target object 102 slightly decreases.

On the other hand, when determining in step S4 that the power P(t) does not exceed the reference electric power, that is, the power P(t) is equal to or smaller than the reference electric power, the control section 46 switches the clutch 17 to the directly connected state (step S6). That is, the control section 46 switches the clutch 17 to a state in which the clutch 17 transmits the rotation of the drum 12 to the electric motor 14 side at a transmission rate of 100%. Specifically, the control section 46 causes the clutch driving section 17*c* to closely attach the clutch plates 17*a* and 17*b* such that the first clutch plate 17*a* and the second clutch plate 17*b* integrally rotate at the same rotating speed. In this case, the electric motor 14 operates as a generator and generates regenerative electric power according to the rotation transmitted to the electric motor 14 side at the transmission rate of 100%. However, the power P(t) of the target object 102 calculated in step S3 is theoretically equivalent to generable maximum limit regenerative electric power and it is determined in step S4 that the power P(t) does not exceed the reference electric power. Therefore, in this case, the regenerative electric power generated by the electric motor 14 does not exceed the reference electric power.

Since the clutch 17 is switched to the directly connected state, the clutch 17 transmits the regenerative braking force received from the electric motor 14 side to the drum 12 side at the transmission rate of 100%. As a result, the rotating speed of the drum 12 in the lowering direction and the falling speed of the target object 102 suddenly decrease. Finally, the freefall of the target object 102 stops.

On the other hand, after step S5, the processing in step S2 and subsequent steps is performed again. The process of steps S2 to S5 is repeatedly performed until the power P(t) of the target object 102 calculated by the power calculating section 42 decreases to be equal to or smaller than the reference electric power. In respective steps S5 of the repeatedly performed process, the control section 46 causes the clutch driving section 17*c* to gradually increase a close attachment degree of the first clutch plate 17*a* and the second clutch plate 17*b* such that the transmission rate of the rotation by the clutch 17 gradually increases. Consequently, the regenerative electric power generated by the electric motor 14 gradually increases. However, the control section 46 causes the clutch driving section 17*c* to gradually increase the strength for closely attaching the clutch plates 17*a* and 17*b* in step S5 to thereby prevent a peak of the regenerative electric power generated by the electric motor 14 from exceeding the reference electric power.

As the close attachment degree of the clutch plates 17*a* and 17*b* gradually increases, the regenerative braking force transmitted to the drum 12 gradually increases so that the rotating speed of the drum 12 in the lowering direction and the falling speed of the target object 102 gradually decrease. As a result, the power P(t) calculated by the power calculating section 42 in step S3 decreases. Finally, it is determined in step S4 that the power P(t) is equal to or smaller than the reference electric power. In step S6, the clutch 17 is switched to the directly connected state. Therefore, in this case as well, the regenerative electric power generated by the electric motor 14 does not exceed the reference electric power. The rotation of the drum 12 in the lowering direction and the freefall of the target object 102 are stopped by the regenerative braking force from the electric motor 14 side.

As explained above, the operation of the electric winch device in stopping the freefall of the target object 102 is performed.

In the first embodiment, when the power P(t) by the freefall of the target object 102 exceeds the reference electric power determined according to the allowable electric power of the electric motor 14, the clutch 17 transmits the rotation of the drum 12 to the electric motor 14 side at the transmission rate at which the regenerative electric power generated by the electric motor 14 is equal to or smaller than the reference electric power. Therefore, even if a large electric motor having large allowable electric power is not used as the electric motor 14, the regenerative electric power generated by the electric motor 14 during the freefall of the target object 102 is reduced to be equal to or smaller than the reference electric power of the electric motor 14. Therefore, it is possible to prevent an increase in the size and an increase in the manufacturing cost of the electric winch device involved in an increase in the size of the electric motor 14. Further, large and expensive components for control for controlling the electric motor having the large allowable electric power are also unnecessary. In this regard as well, it is possible to prevent an increase in the size and an increase in the manufacturing cost of the electric winch device.

In the first embodiment, the power calculating section 42 calculates, as the power of the target object 102 by the freefall, the power P(t) of the target object 102 at the falling speed derived by the speed deriving section 48 at the timing when the operation of the pedal 28*a* for stopping the freefall of the target object 102 is performed. The control of the clutch 17 is performed on the basis of the calculated power P(t). Therefore, it is possible to reflect the power P(t) corresponding to accurate falling speed of the target object 102 during the stop operation for the freefall of the target object 102 on the control of the transmission rate to the electric motor 14 side of the rotation of the drum 12 by the clutch 17. As a result, it is possible to implement accurate control of the transmission rate of the rotation of the drum 12 to the electric motor 14 side corresponding to actual falling speed of the target object 102 during the freefall.

(Second Embodiment)

In an electric winch device according to a second embodiment of the present invention, upper limit power of the target object 102 during freefall is calculated by an arithmetic operation on the basis of the height of the position of the target object 102 at a time point of start of the freefall. It is determined on the basis of the calculated power, whether control for changing a transmission rate of a rotation by the clutch 17 is performed.

Figure 4:
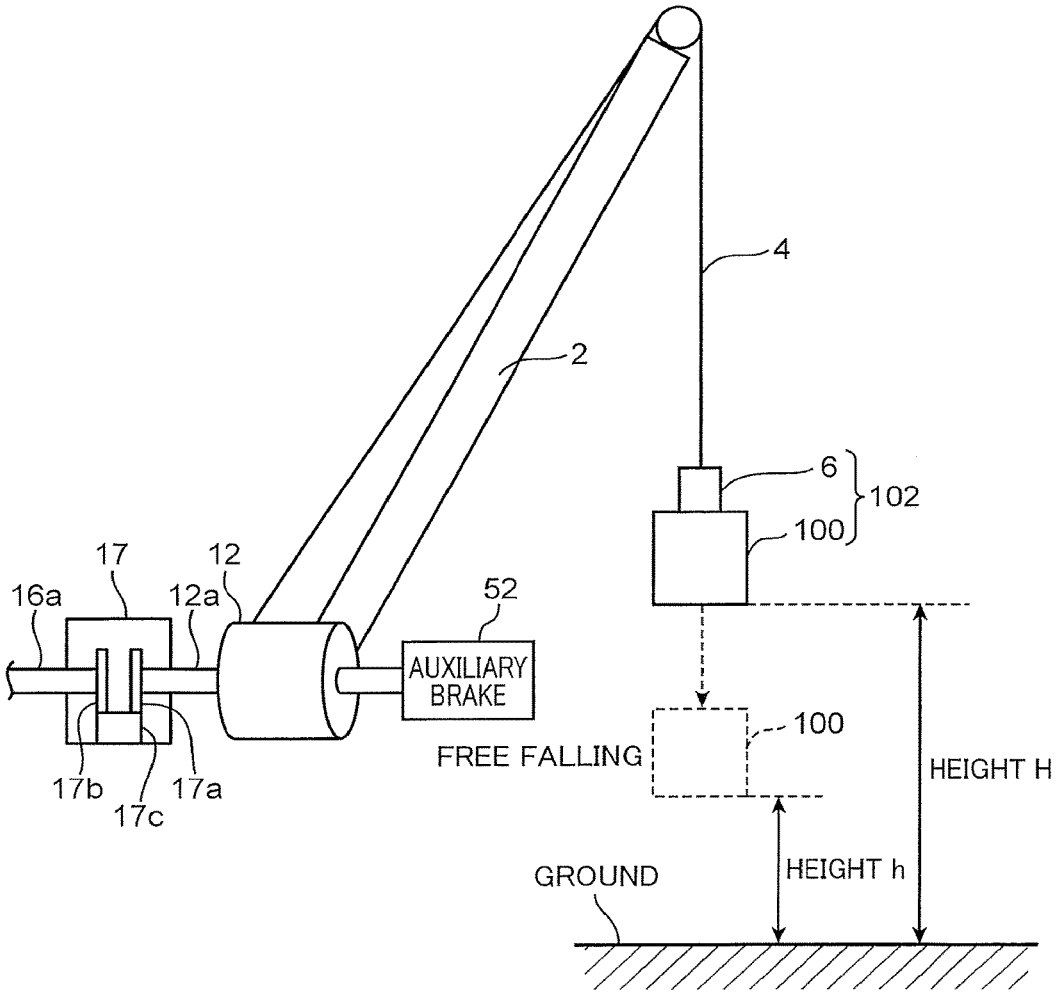
FIG. 4 is a schematic diagram partially showing the configuration of an electric winch device according to a second embodiment of the present invention.
Figure 5:
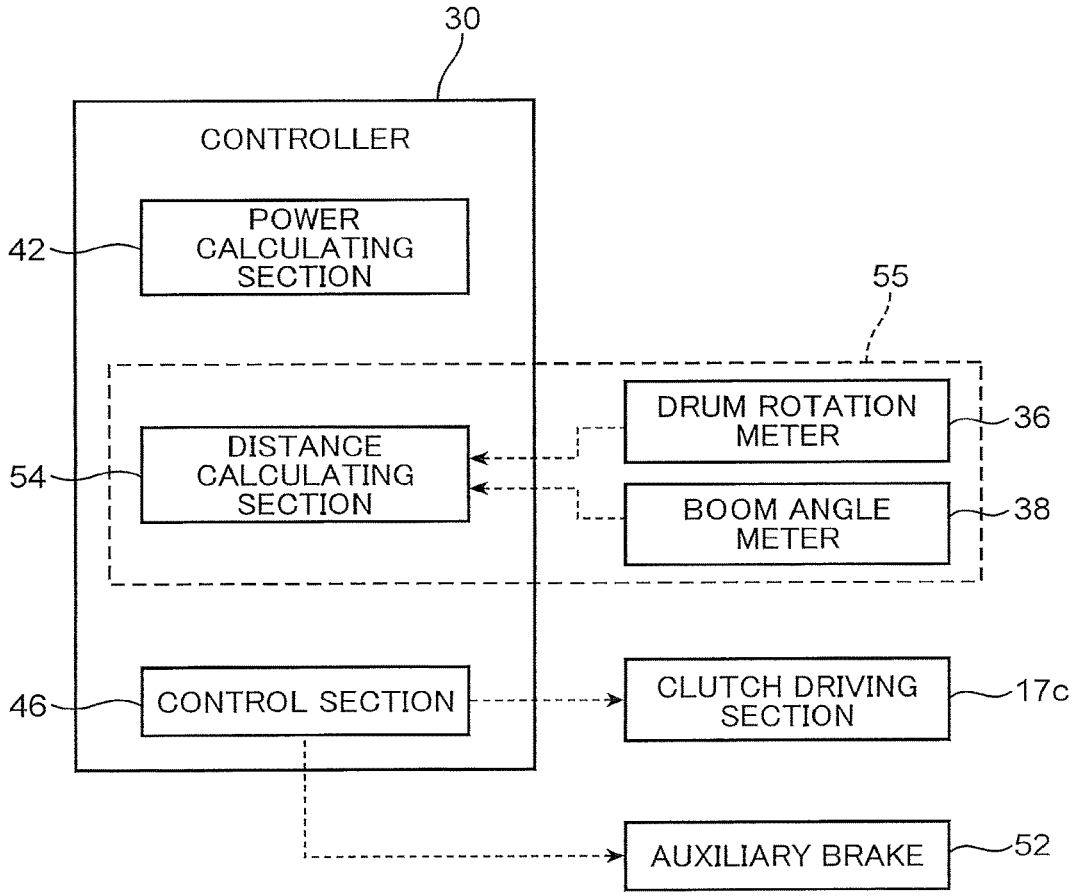
FIG. 5 is a functional block diagram of a controller of the electric winch device according to the second embodiment.

In FIG. 4, the configuration of the electric winch device according to the second embodiment is partially shown. In FIG. 5, the configuration related to the controller 30 of the electric winch device according to the second embodiment is shown. The configuration of the electric winch device according to the second embodiment is explained with reference to FIG. 4 and FIG. 5.

As shown in FIG. 4, the electric winch device according to the second embodiment includes an auxiliary brake 52 for applying a braking force to the drum 12. As the auxiliary brake 52, mechanical publicly-known various drum brakes are used. As shown in FIG. 5, the auxiliary brake 52 is electrically connected to the control section 46 of the controller 30. The auxiliary brake 52 is switched to, according to a control signal from the control section 46, an ON state for applying a braking force to the drum 12 and an OFF state for not applying the braking force to the drum 12.

In the second embodiment, the controller 30 includes a distance calculating section 54 (see FIG. 5).

The distance calculating section 54 calculates a maximum distance of the freefall of the target object 102 at the time point of start of the freefall of the target object 102. Specifically, the distance calculating section 54 calculates, as a maximum distance of the freefall of the target object 102, a distance from an initial height position, which is a height position of the target object 102 at the time point of start of the freefall of the target object 102, to the ground, which is a minimum height position to which the target object 102 can fall. More specifically, the distance calculating section 54 calculates height H from the ground of the lower surface of the target object 102 present in the initial height position as the maximum distance of the freefall using data of a raising/lowering angle of the boom 2 detected by the boom angle meter 38, data of a rotation amount of the drum 12 detected by the drum rotation meter 36, and other setting values. Therefore, in the second embodiment, the distance deriving section 55 that derives the maximum distance of the freefall of the target object 102 at the time point of start of the freefall is configured by the distance calculating section 54, the boom angle meter 38, and the drum rotation meter 36.

In the second embodiment, the power calculating section 42 calculates upper limit power P(h) of the target object 102 during the freefall of the target object 102 on the basis of the maximum distance of the freefall calculated by the distance calculating section 54.

The control section 46 determines on the basis of the upper limit power P(h) calculated by the power calculating section 42 whether control of the clutch 17 for adjusting a transmission rate of a rotation to the electric motor 14 side by the clutch 17 to a transmission rate lower than the transmission rate in the directly connected state and control for switching the auxiliary brake 52 to the ON state are performed or control for switching the clutch 17 to the directly connected state is performed. In the second embodiment, the control section 46 does not perform the control of the clutch 17 in the first embodiment for gradually increasing the transmission rate of the rotation by the clutch 17 on the basis of the power P(t) corresponding to the actual falling speed of the target object 102. Details of the control of the clutch 17 by the control section 46 in the second embodiment are explained below.

Configurations other than the configuration explained above of the electric winch device according to the second embodiment are the same as the configurations of the electric winch device according to the first embodiment.

The operation of the electric winch device according to the second embodiment is explained with reference to the flowchart of FIG. 6.

First, in an initial state, the clutch 17 (see FIG. 4) is in the directly connected state and the auxiliary brake 52 is in the ON state. The target object 102 is stopped in a state of hanging from the distal end portion of the boom 2. In the state, brake-off operation for starting the freefall of the target object 102 is performed by an operator (step S11). Specifically, the operator returns the stepped-in pedal 28*a* (see FIG. 1) to the reference position. According to this, the control section 46 (see FIG. 5) causes the clutch driving section 17*c* to separate the clutch plates 17*a* and 17*b* (see FIG. 4) to thereby switch the clutch 17 to a disconnected state, and switches the auxiliary brake 52 to the OFF state. As a result, the drum 12 starts to rotate in the lowering direction and the freefall of the target object 102 is started.

According to the performed brake-off operation, the distance calculating section 54 (see FIG. 5) of the controller 30 calculates a maximum distance of the freefall of the target object 102 (step S12). Specifically, the distance calculating section 54 calculates, as the maximum distance of the freefall of the target object 102, the height H (see FIG. 4) from the ground of the lower surface of the target object 102 in the initial state in which the target object 102 is stopped in the state of hanging. Specifically, the distance calculating section 54 calculates initial height H as explained below.

The distance calculating section 54 calculates height from the ground of the distal end portion of the boom 2 on the basis of the length in the axial direction of the boom 2 and the height from the ground of the proximal end portion of the boom 2, which are setting values, and the raising/lowering angle of the boom 2 detected by the boom angle meter 38 (see FIG. 5). The distance calculating section 54 calculates letting-out length of the hoisting rope 4 from the drum 12 from the data of the rotation amount of the drum 12 detected by the drum rotation meter 36 (see FIG. 5) and calculates a hanging distance of the target object 102 downward from the distal end portion of the boom 2 on the basis of the calculated letting-out length. The distance calculating section 54 calculates the initial height H of the target object 102 by subtracting the hanging distance of the target object 102 and a dimension of the target object 102 in the up-down direction, which is a setting value, from the height of the distal end portion of the boom 2.

Subsequently, the power calculating section 42 calculates the upper limit power P(h) of the target object 102 during the freefall on the basis of the initial height H of the target object 102 serving as the maximum distance of the freefall calculated by the distance calculating section 54 (step S13).

Specifically, first, when the height from the ground of the lower surface of the target object 102 during the freefall is represented as h ($0 \le h \le H$) (see FIG. 4), the power calculating section 42 calculates upper limit falling speed v(h) at the time when the target object 102 reaches the height h as indicated by the following Expression (2) from the law of conservation of energy.

[Math. 2]

$$v(h)=\sqrt{2g(H-h)} \tag{2}$$

The power calculating section 42 calculates the upper limit power P(h) of the target object 102 during the freefall on the basis of the calculated upper limit falling speed v(h). Specifically, the power calculating section 42 calculates the upper limit power P(h) according to the following Expression (3)

[Math. 3]

$$P(h)=mgv(h)=mg\sqrt{2g(H-h)} \tag{3}$$

Subsequently, brake-on operation of the pedal 28*a* for stopping the freefall of the target object 102 is performed by the operator (step S14). That is, the operator steps in the pedal 28*a* from the reference position.

Thereafter, the control section 46 determines whether the upper limit power P(h) calculated by the power calculating section 42 in step S13 exceeds reference electric power set in advance according to allowable electric power of the electric motor 14 (step S15).

When determining that the upper limit power P(h) exceeds the reference electric power, subsequently, the control section 46 performs control of the clutch 17 for adjusting the transmission rate of the rotation of the drum 12 to the electric motor 14 side and performs control of the auxiliary brake 52 for switching the auxiliary brake 52 to the ON state (step S17).

Specifically, the control section 46 causes the clutch driving section 17*c* to adjust the coupling state of the clutch plates 17*a* and 17*b* such that the transmission rate of the rotation of the drum 12 to the electric motor 14 side by the clutch 17 changes to a transmission rate at which the regenerative electric power, which the electric motor 14 generates according to the transmission of the rotation to the electric motor 14, decreases to be equal to or smaller than the reference electric power. That is, the coupling state of the clutch plates 17*a* and 17*b* is adjusted to a coupling state in which the first clutch plate 17*a* slips while sliding with respect to the second clutch plate 17*b* and the rotation is transmitted from the first clutch plate 17*a* to the second clutch plate 17*b* to a certain degree. The electric motor 14 generates the regenerative electric power according to the transmission of the rotation of the drum 12 to the electric motor 14 side. On the other hand, the regenerative braking force is applied from the electric motor 14 side to the drum 12 side. In this case, the regenerative electric power generated by the electric motor 14 does not exceed the reference electric power.

The control section 46 switches the auxiliary brake 52 to the ON state, whereby a braking force is applied from the auxiliary brake 52 to the drum 12. The rotation of the drum 12 in the lowering direction is braked by the braking force and the regenerative braking force from the auxiliary brake 52. As a result, the rotating speed of the drum 12 decreases and the falling speed of the target object 102 decreases. Finally, the rotation of the drum 12 in the lowering direction and the freefall of the target object 102 are stopped.

On the other hand, when determining in step S15 that the upper limit power P(h) does not exceed the reference electric power, that is, the upper limit power P(h) is equal to or smaller than the reference electric power, subsequently, the control section 46 switches the clutch 17 to the directly connected state (step S16). That is, the control section 46 switches the clutch 17 to a state in which the clutch 17 transmits the rotation of the drum 12 to the electric motor 14 side at a transmission rate of 100%. The processing in step S16 is the same as the processing in step S6 in the first embodiment.

In this case, theoretically, it is determined in step S15 that the upper limit power P(h) equivalent to generable maximum regenerative electric power does not exceed the reference electric power. Therefore, the regenerative electric power generated by the electric motor 14 does not exceed the reference electric power. In this case, the rotating speed of the drum 12 in the lowering direction and the falling speed of the target object 102 are reduced by only the regenerative braking force applied to the drum 12 from the electric motor 14 side. Finally, the rotation of the drum 12 in the lowering direction and the freefall of the target object 102 are stopped.

In the second embodiment, for example, compared with a case in which rotating speed of the drum 12 indicating the falling speed of the target object 102 is measured and power of the target object 102 during the freefall is calculated on the basis of the measured rotating speed of the drum 12, it is possible to improve responsiveness from the time when the brake-on operation of the pedal 28*a* is performed until control for changing the transmission rate of the rotation by the clutch 17 is executed.

Specifically, when the rotating speed of the drum 12 is actually measured, a delay sometimes occurs in the measurement. In this case, the calculation of power is delayed and the determination concerning whether the power exceeds the reference electric power is delayed. Therefore, the execution of the control for changing the transmission rate of the rotation of the drum 12 to the electric motor 14 side by the clutch 17 to the transmission rate at which the regenerative electric power by the electric motor 14 is equal to or smaller than the reference electric power is delayed. On the other hand, in the second embodiment, the upper limit power P(h) of the target object 102 during the freefall calculated on the basis of the maximum distance of the freefall derived at the time point of start of the freefall of the target object 102 is used as a reference for determining whether change control of the transmission rate of the rotation to the electric motor 14 side by the clutch 17 after the brake-on operation of the pedal 28*a* for stopping the freefall is performed. Therefore, it is possible to prevent occurrence of the delay of responsiveness due to the delay of the measurement of the rotating speed of the drum 12 explained above. Therefore, it is possible to improve the responsiveness from the time when the brake-on operation of the pedal 28*a* is performed until the control for changing the transmission rate of the rotation by the clutch 17 is executed.

Effects other than the effects explained above according to the second embodiment are the same as the effects according to the first embodiment.

Note that the embodiments disclosed herein should be considered illustrative and not restrictive in all aspects. The scope of the present invention is indicated by claims not by the explanation of the embodiments and includes all changes within meanings and scopes equivalent to claims.

For example, processing equivalent to steps S2 to S5 in the first embodiment may be performed instead of the processing in step S17 in the second embodiment. Such a control process according to a first modification of the second embodiment is shown in FIG. 7.

Figure 6:
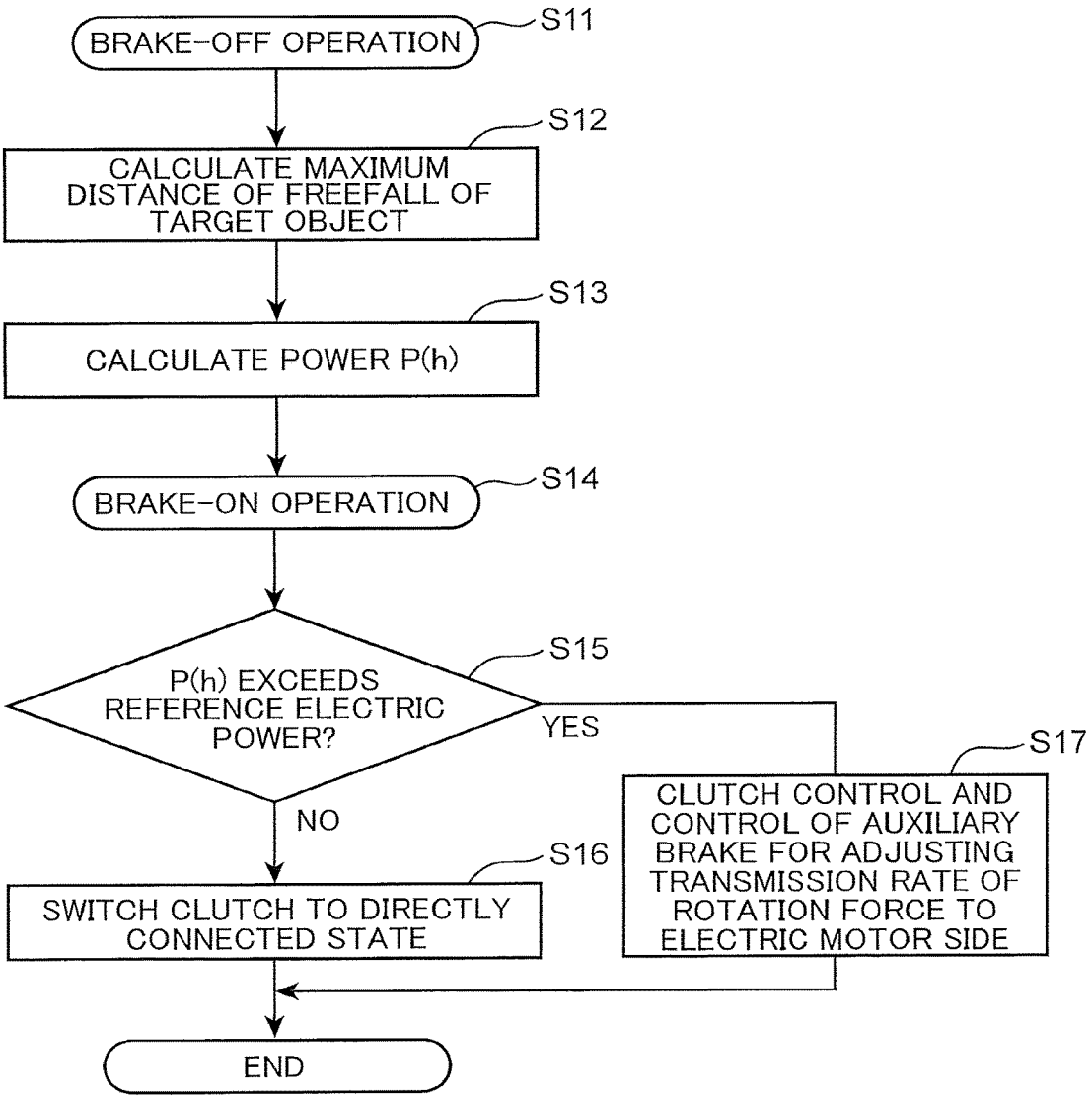
FIG. 6 is a flowchart showing an operation from a start to a stop of a freefall of a target object in the electric winch device according to the second embodiment.
Figure 7:
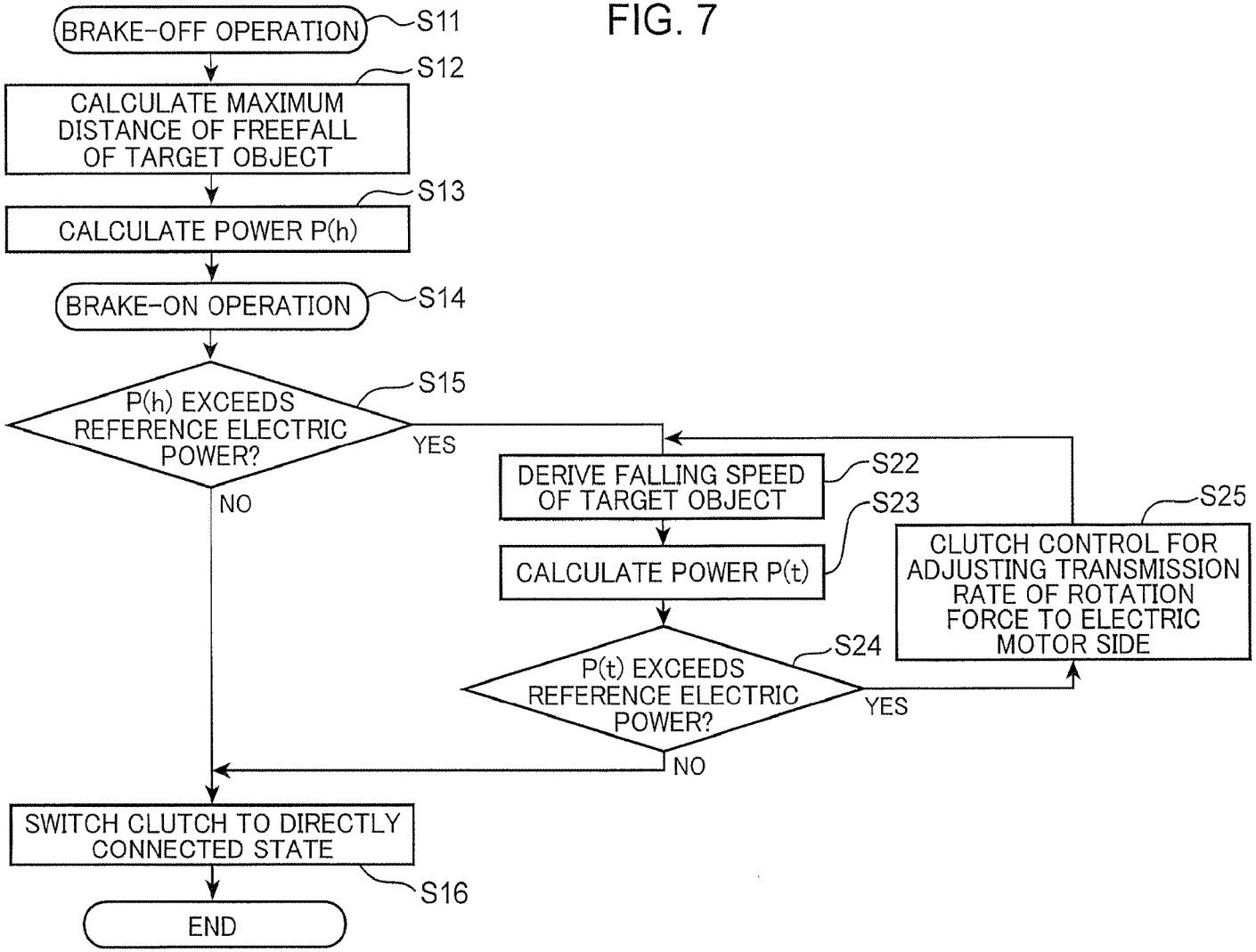
FIG. 7 is a flowchart showing an operation from a start to a stop of a freefall of a target object in an electric winch device according to a first modification of the second embodiment.

Specifically, steps S11 to S16 in the control process in the first modification shown in FIG. 7 are the same as steps S11 to S16 in the control process in the second embodiment shown in FIG. 6. In the first modification, after the control section 46 determines in step S15 that the upper limit power P(h) exceeds the reference electric power, processing in steps S22 to S25 equivalent to steps S2 to S5 in the control process in the first embodiment is performed.

Figure 8:
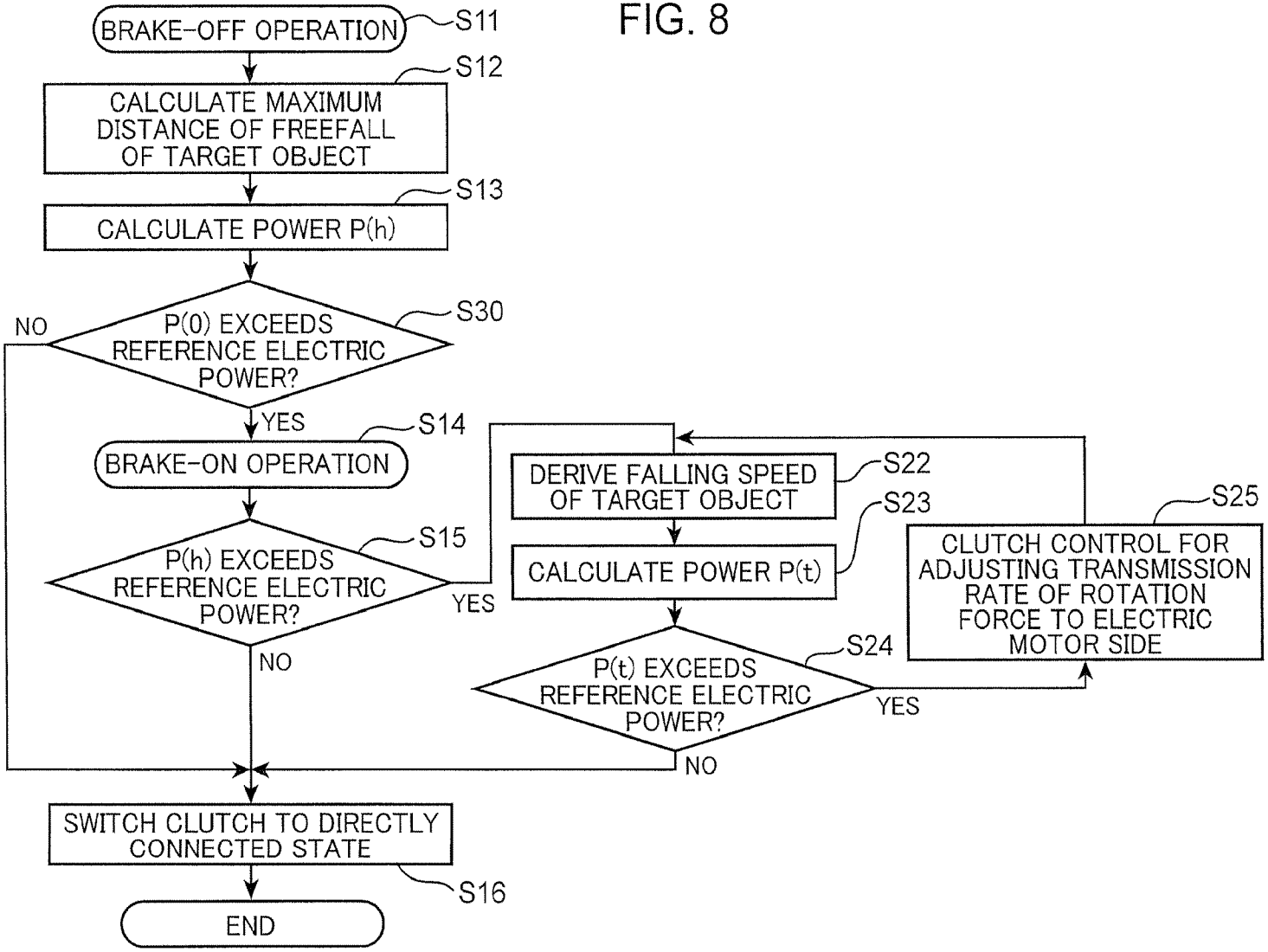
FIG. 8 is a flowchart showing an operation from a start to a stop of a freefall of a target object in an electric winch device according to a second modification of the second embodiment.

As a second modification of the second embodiment, after the start of the freefall of the target object 102, before the brake-on operation of the pedal 28*a* for stopping the freefall is performed, the control section 46 may calculate predicted maximum power P(0) of the target object 102 obtained if the target object 102 free-falls by a maximum distance and, when the predicted maximum power P(0) is equal to or smaller than the reference electric power, switch the clutch 17 to the directly connected state to cause the clutch 17 to transmit the rotation of the drum 12 to the electric motor 14 side at the transmission rate of 100%. Such a control process according to the second modification is shown in FIG. 8.

The control process according to the second modification is different from the control process according to the first modification only in that determination in step S30 is performed between step S13 and step S14.

Specifically, in the second modification, after calculating the upper limit power P(h) of the target object 102 during the freefall in step S13, the power calculating section 42 calculates the predicted maximum power P(0) and the control section 46 determines whether the predicted maximum power P(0) exceeds the reference electric power (step S30).

Theoretically, falling speed of the target object 102 during the freefall reaches maximum falling speed when the target object 102 free-falls by the maximum distance, that is, at an instance when the height h from the ground to the lower surface of the target object 102 is zero. Power at that instance is theoretically maximum power.

Therefore, the power calculating section 42 calculates predicted maximum speed v(0), which is falling speed that the target object 102 reaches when the target object 102 free-falls by the maximum distance, according to the following Expression (4) and calculates power at the time when the target object 102 reaches the calculated predicted maximum speed v(0) as the predicted maximum power P(0) according to the following Expression (5).

[Math. 4]

$$v(0)=\sqrt{2gh} \tag{4}$$

[Math. 5]

$$P(0)=mgv(0)=mg\sqrt{2gH} \tag{5}$$

Note that Expression (4) is an expression obtained by substituting h=0 in Expression (2) for calculating the falling speed v(h) of the target object 102 during the freefall in the second embodiment.

When determining in step S30 that the predicted maximum power P(0) does not exceed the reference electric power, the control section 46 performs processing for switching the clutch 17 to the directly connected state in step S16. That is, the predicted maximum power P(0) not exceeding the reference electric power means that, even if the entire rotation of the drum 12 by the freefall of the target object 102 is converted into regenerative electric power by the electric motor 14, the regenerative electric power does not exceed the reference electric power. Therefore, irrespective of the brake-on operation of the pedal 28*a*, the control section 46 switches the clutch 17 to the directly connected state to cause the clutch 17 to transmit the rotation of the drum 12 to the electric motor 14 side at the transmission rate of 100%.

On the other hand, when the control section 46 determines in step S30 that the predicted maximum power P(0) exceeds the reference electric power, thereafter, the brake-on operation of the pedal 28*a* is performed (step S14). After step S14, processing same as the processing in the first modification is performed.

In the second modification, at a time point immediately after the start of the freefall of the target object 102, it is possible to determine that regenerative electric power generated by the electric motor 14 does not exceed the reference electric power, on the basis of the predicted maximum power P(0), and cause the clutch 17 to transmit the rotation of the drum 12 to the electric motor 14 side at the transmission rate of 100%. Therefore, complicated determination processing in the control section 46 during the freefall of the target object 102 is unnecessary. It is possible to simplify processing in the control section 46.

In the control processes in the embodiments and the modifications, when the power P(t) or P(h) calculated by the power calculating section 42 exceeds the reference electric power, the control section 46 may cause the clutch driving section 17*c* to separate the first clutch plate 17*a* and the second clutch plate 17*b* each other to thereby reduce the transmission rate of the rotation to the electric motor 14 side to 0%. In this case, the clutch driving section 17*c* only has to have a function of switching the clutch plates 17*a* and 17*b* to the directly connected state for closely attaching the clutch plates 17*a* and 17*b* and integrally rotating the clutch plates 17*a* and 17*b* at the same rotating speed and the disconnected state for completely separating the clutch plates 17*a* and 17*b* and enabling the clutch plates 17*a* and 17*b* to relatively rotate. The clutch driving section 17*c* in this case is an example of a switching device of the present invention.

Specifically, in steps S5, S17, and S25 of the control processes, the clutch driving section 17*c* completely separates the clutch plates 17*a* and 17*b* to switch the clutch plates 17*a* and 17*b* to the disconnected state instead of finely adjusting the coupling state of the clutch plates 17*a* and 17*b*. Consequently, the rotation of the drum 12 is not transmitted to the electric motor 14 side at all. Therefore, since the regenerative electric power is not generated by the electric motor 14, the regenerative electric power does not exceed the reference electric power. However, in this case, since the regenerative braking force is not obtained, the auxiliary brake 52 (see FIG. 4) is provided. The braking force is applied from the auxiliary brake 52 to the drum 12 to stop the freefall of the target object 102.

In this modification, it is possible to prevent an overload of the electric motor 14 with simple control of the clutch driving section 17*c* compared with when control for gradually finely adjusting the coupling state of the first clutch plate 17*a* and the second clutch plate 17*b*.

The clutch 17 is not limited to a dry clutch and may be a wet clutch. The wet clutch has a structure in which a clutch plate and a clutch driving section are covered with a cover and the inside of the cover is filled with oil. As the wet clutch, there is known a wet clutch including a plurality of clutch plates and configured to disperse force applied per one clutch plate. Such a wet clutch may be applied as the clutch 17. The wet clutch is superior to the dry clutch in terms of durability, dust resistance, water resistance, and the like. Therefore, in use in which a clutch of an electric winch device is frequency used as in a mobile crane, it is suitable in terms of maintainability and the like to use the wet clutch as the clutch 17.

The freefall in the present invention is not always limited to a free fall in which acceleration applied to a target object coincides with the gravitational acceleration g. That is, the freefall of the target object according to the present invention may be a falling motion of the target object in which downward acceleration having a value different from the gravitational acceleration g is applied to the target object. The downward acceleration applied to the target object does not always have to be fixed and may change with time in a process of falling.

For example, when the wet clutch is used, even if the clutch is in the disconnected state, the fall of the target object is not a simple free fall because of, for example, viscous resistance of the oil filled in the cover of the wet clutch. The freefall of the target object in the present invention is a concept including the fall of the target object in such a form as well.

In the control processes, in the brake-on operation, the operator does not have to step in the pedal 28*a* to a maximum position to which the pedal 28*a* can be stepped in and may step in the pedal 28*a* to any position between the reference position and the maximum step-in position. In this case, in steps S6 and S16, the control section 46 only has to switch the coupling state of the clutch plates 17*a* and 17*b* of the clutch 17 to a coupling state corresponding to a step-in amount (an operation amount) from the reference position of the pedal 28*a* rather than switching the clutch 17 to the directly connected state. However, in this case, since the regenerative braking force applied to the drum 12 is smaller than when the clutch 17 is switched to the directly connected state, the operator adjusts the step-in amount from the reference position of the pedal 28*a* taking that into account.

In the electric winch device in the first embodiment shown in FIG. 1, the auxiliary brake 52 in the second embodiment that applies the braking force to the drum 12 may be added.

The target object of hoisting/lowering is not limited to the target object explained above in which the hook device and the lifting load are integrated. For example, a bucket like a clamshell may be the target object. The present invention may be applied to an electric winch device of a crane that causes the bucket to free-fall to perform excavation.

[Summary of the Embodiments]

The embodiments are summarized as described below.

An electric winch device according to the embodiments is an electric winch device provided in a crane to perform hoisting and lowering of a target object, the electric winch device including: a winch drum which rotates for the hoisting and the lowering of the target object; an electric motor which rotates the winch drum in a hoisting direction during the hoisting of the target object, and generates regenerative electric power when a rotation of the winch drum in a lowering direction during a freefall of the target object is transmitted to the electric motor; a transmission device which transmits the rotation between the electric motor and the winch drum, the transmission device having a variable transmission rate which is a rate of transmission of the rotation of the winch drum in the lowering direction during the freefall to the electric motor side; a power calculating section which calculates power of the target object by the freefall; and a control section which controls an operation of the transmission device for changing the transmission rate. When the power calculated by the power calculating section exceeds reference electric power set according to allowable electric power of the electric motor, the control section causes the transmission device to change the transmission rate of the rotation from the winch drum to the electric motor side to a transmission rate at which the regenerative electric power generated by the electric motor is equal to or smaller than the reference electric power.

In the electric winch device, when the power of the target object by the freefall exceeds the reference electric power determined according to the allowable electric power of the electric motor, the transmission rate of the rotation of the winch drum to the electric motor side by the transmission device is changed to the transmission rate at which the regenerative electric power generated by the electric motor is equal to or smaller than the reference electric power. Therefore, even if a large electric motor having large allowable electric power is not used, the regenerative electric power generated by the electric motor during the freefall of the target object does not exceed the reference electric power. Therefore, it is possible to prevent an increase in the size and an increase in the manufacturing cost of the electric winch device. Further, large and expensive components for control for controlling the electric motor having the large allowable electric power are also unnecessary. In this regard as well, it is possible to prevent an increase in the size and an increase in the manufacturing cost of the electric winch device.

The electric winch device may further include: a brake operation section which is operated to stop the freefall of the target object; and a speed deriving section which successively derives falling speed of the target object. The power calculating section may calculate, on the basis of falling speed derived by the speed deriving section at timing when the operation of the brake operation section for stopping the freefall of the target object is performed, power of the target object at the timing as the power of the target object by the freefall.

With this configuration, it is possible to reflect power corresponding to accurate falling speed of the target object during the stop operation for the freefall of the target object on the control of the transmission rate to the electric motor side of the rotation of the winch drum. Therefore, it is possible to implement accurate control of the transmission rate of the rotation of the winch drum to the electric motor side corresponding to actual falling speed of the target object during the freefall.

The electric winch device may further include: a brake operation section which is operated to stop the freefall of the target object; and a distance deriving section which derives a maximum distance of the freefall of the target object at a time point of start of the freefall of the target object. The power calculating section may calculate, on the basis of the maximum distance derived by the distance deriving section, upper limit power of the target object during the freefall as power of the target object by the freefall. When the upper limit power calculated by the power calculating section exceeds the reference electric power after the operation of the brake operation section for stopping the freefall of the target object is performed, the control section may cause the transmission device to change the transmission rate of the rotation from the winch drum to the electric motor side to a transmission rate at which the regenerative electric power generated by the electric motor is equal to or smaller than the reference electric power.

With this configuration, for example, compared with when a speed index value indicating falling speed of the target object is measured and power is calculated on the basis of the measured speed index value, it is possible to improve responsiveness from the time when the brake operation section is operated until control for changing the transmission rate of the rotation by the transmission device is executed. Specifically, when the speed index value of the target object is actually measured, a delay sometimes occurs in the measurement. As a result, the calculation of the power is delayed and the determination concerning whether the power exceeds the reference electric power is delayed. Therefore, the execution of the control for causing the transmission device to change the transmission rate of the rotation of the winch drum to the electric motor side to the transmission rate at which the regenerative electric power by the electric motor is equal to or smaller than the reference electric power is delayed. On the other hand, in this configuration, the upper limit power of the target object during the freefall is calculated on the basis of the maximum distance of the freefall derived at the time point of start of the freefall of the target object and the calculated power is used as a reference for determining whether change control of the transmission rate of the rotation to the electric motor side by the transmission device after the operation of the brake operation section is performed Therefore, it is possible to prevent the delay from the time when the brake operation section is operated until the control for changing the transmission rate of the rotation by the transmission device is executed from increasing. Therefore, it is possible to improve the responsiveness from the time when the brake operation section is operated until the control for changing the transmission rate of the rotation by the transmission device is executed.

In this case, it is preferable that the power calculating section calculates predicted maximum speed, which is falling speed which the target object reaches when the target object free-falls by the maximum distance derived by the distance deriving section, and calculates predicted maximum power, which is power of the target object at the time when the target object reaches the calculated predicted maximum speed, and, when the predicted maximum power is equal to or smaller than the reference electric power, the control section causes the transmission device to transmit the rotation of the winch drum to the electric motor side at a transmission rate of 100%.

With this configuration, the control section can determine, at the time point of start of the freefall of the target object, on the basis of the predicted maximum power, that the regenerative electric power generated by the electric motor does not exceed the reference electric power and cause the transmission device to transmit the rotation of the winch drum to the electric motor side at the transmission rate of 100% during the freefall of the target object Therefore, complicated determination processing in the control section during the freefall of the target object is unnecessary. It is possible to simplify processing in the control section.

In the electric winch device, the transmission device may include: a first rotating section which rotates integrally with the winch drum; a second rotating section which rotates together with a driving shaft of the electric motor; and a changing device which changes a coupling state between the first rotating section and the second rotating section. When the power calculated by the power calculating section exceeds the reference electric power, the control section may cause the changing device to change the coupling state between the first rotating section and the second rotating section to a coupling state in which the first rotating section slips relative to the second rotating section so that rotating speed of the second rotating section is lower than rotating speed of the first rotating section.

With this configuration, it is possible to provide specific configurations of the transmission device and the control section for reducing the transmission rate of the rotation of the winch drum to the electric motor side and preventing an overload of the electric motor when the power of the target object by the freefall exceeds the reference electric power of the electric motor.

In the electric winch device, the transmission device may include: a first rotating section which rotates integrally with the winch drum; a second rotating section which rotates together with a driving shaft of the electric motor, and a switching device which switches coupling and separation between the first rotating section and the second rotating section. When the power calculated by the power calculating section exceeds the reference electric power, the control section may cause the switching device to separate the first rotating section and the second rotating section from each other to thereby reduce the transmission rate by the transmission device to 0%.

With this configuration, it is possible to provide specific configurations of the transmission device and the control section for reducing the transmission rate of the rotation of the winch drum to the electric motor side and preventing an overload of the electric motor when the power of the target object by the freefall exceeds the reference electric power of the electric motor. With this configuration, the transmission rate of the rotation of the winch drum to the electric motor side is reduced by only performing the control for causing the switching device of the transmission device to separate the first rotating section and the second rotating section, which are in a coupling state each other, from each other. Therefore, it is possible to prevent an overload of the electric motor with simple control compared with when control for gradually finely adjusting the coupling state of the first rotating section and the second rotating section.

In the configuration in which the transmission device includes the first rotating section and the second rotating section and the changing device or the switching device, the transmission device may be a wet clutch.

Since the wet clutch has high durability compared with a dry clutch, with this configuration, it is possible to obtain the transmission device having high durability. As a result, it is possible to improve the durability of the electric winch device.

As explained above, according to the embodiments, it is possible to prevent an increase in the size and an increase in the manufacturing cost of an electric winch device of a crane including a regeneration function and capable of implementing a freefall of a target object.

The invention claimed is:

1. An electric winch device provided in a crane to perform hoisting and lowering of a target object, the electric winch device comprising:

a winch drum which rotates for the hoisting and the lowering of the target object;

an electric motor which rotates the winch drum in a hoisting direction during the hoisting of the target object, and generates regenerative electric power when a rotation of the winch drum in a lowering direction during a freefall of the target object is transmitted to the electric motor;

a transmission device which transmits the rotation between the electric motor and the winch drum, the transmission device having a variable transmission rate which is a rate of transmission of the rotation of the winch drum in the lowering direction during the freefall to the electric motor;

a power calculating section which calculates power of the target object by the freefall; and a control section which controls an operation of the transmission device for changing the transmission rate, wherein when the power calculated by the power calculating section exceeds reference electric power set according to allowable electric power of the electric motor, the control section causes the transmission device to change the transmission rate of the rotation from the winch drum to the electric motor to a transmission rate at which the regenerative electric power generated by the electric motor is equal to or smaller than the reference electric power.

2. The electric winch device according to claim 1, further comprising:

a brake operation section which is operated to stop the freefall of the target object; and a speed deriving section which successively derives falling speed of the target object, wherein the power calculating section calculates, on the basis of falling speed derived by the speed deriving section at timing when the operation of the brake operation section for stopping the freefall of the target object is performed, power of the target object at the timing as the power of the target object by the freefall.

3. The electric winch device according to claim 1, further comprising:

a brake operation section which is operated to stop the freefall of the target object; and a distance deriving section which derives a maximum distance of the freefall of the target object at a time point of start of the freefall of the target object, wherein the power calculating section calculates, on the basis of the maximum distance derived by the distance deriving section, upper limit power of the target object during the freefall as power of the target object by the freefall, and when the upper limit power calculated by the power calculating section exceeds the reference electric power after the operation of the brake operation section for stopping the freefall of the target object is performed, the control section causes the transmission device to change the transmission rate of the rotation from the winch drum to the electric motor to a transmission rate at which the regenerative electric power generated by the electric motor is equal to or smaller than the reference electric power.

4. The electric winch device according to claim 3, wherein the power calculating section calculates predicted maximum speed, which is falling speed which the target object reaches when the target object free-falls by the maximum distance derived by the distance deriving section, and calculates predicted maximum power, which is power of the target object at a time when the target object reaches the calculated predicted maximum speed, and when the predicted maximum power is equal to or smaller than the reference electric power, the control section causes the transmission device to transmit the rotation of the winch drum to the electric motor at a transmission rate of 100%.

5. The electric winch device according to claim 1, wherein the transmission device includes:

a first rotating section which rotates integrally with the winch drum;

a second rotating section which rotates together with a driving shaft of the electric motor; and a changing device which changes a coupling state between the first rotating section and the second rotating section, and when the power calculated by the power calculating section exceeds the reference electric power, the control section causes the changing device to change the coupling state between the first rotating section and the second rotating section to a coupling state in which the first rotating section slips relative to the second rotating section so that rotating speed of the second rotating section is lower than rotating speed of the first rotating section.

6. The electric winch device according to claim 5, wherein the transmission device is a wet clutch.

7. The electric winch device according to claim 1, wherein the transmission device includes:

a first rotating section which rotates integrally with the winch drum;

a second rotating section which rotates together with a driving shaft of the electric motor; and a switching device which switches coupling and separation between the first rotating section and the second rotating section, and when the power calculated by the power calculating section exceeds the reference electric power, the control section causes the switching device to separate the first rotating section and the second rotating section from each other to thereby reduce the transmission rate by the transmission device to 0%.

8. The electric winch device according to claim 7, wherein the transmission device is a wet clutch.

* * * * *